US005816984A

United States Patent [19]

Weiss

[11] Patent Number: 5,816,984

[45] Date of Patent: Oct. 6, 1998

[54] FLEXIBLE RESISTANCE EXERCISER

[76] Inventor: Lou Weiss, 31022 Aliso Cir., Laguna Beach, Calif. 92677

[21] Appl. No.: 759,125

[22] Filed: Dec. 2, 1996

[51] Int. Cl.[6] ..... A63B 21/02

[52] U.S. Cl. ..... 482/121; 482/122; 482/126

[58] Field of Search ..... 482/121, 122, 482/126, 123, 124, 125, 127; 428/195

[56] References Cited

U.S. PATENT DOCUMENTS

| | | | |
|---|---|---|---|
| 3,819,177 | 6/1974 | Sprio | 482/122 |
| 4,040,620 | 8/1977 | Friedman | 482/125 |
| 4,290,599 | 9/1981 | Berger | 482/126 |
| 4,609,579 | 9/1986 | Hills | 428/195 |
| 4,976,427 | 12/1990 | Pantucek | 482/126 |

*Primary Examiner*—Lynne A. Reichard
*Attorney, Agent, or Firm*—Finnegan, Henderson, Farabow, Garrett & Dunner, L.L.P.

[57] ABSTRACT

A flexible resistance exerciser is provided which includes a stretchable member having fixable portions and at least one indicator positioned at a preselected location on the stretchable member visible to a user of the exercise equipment and identifying to the user a desirable location on the stretchable member, a relative degree of resistance provided by the stretchable member, fatigue of the stretchable member or any combination thereof. The indicator may take the form of a contrasting colored area, lines, symbols, words and the indicator may change configuration as the stretchable member is stretched.

19 Claims, 3 Drawing Sheets

FLEXIBLE RESISTANCE EXERCISER

BACKGROUND OF THE INVENTION

1. Field of the Invention

The present invention relates to exercise equipment. More particularly, the present invention relates to modifications of exercise equipment to provide safety and use guidelines to users.

2. Description of the Related Art

Home gyms and exercise equipment are a very popular means for people to keep in shape. Catering to this, a large portion of the exercise equipment industry has focused on specialized exercise equipment for the home user. The intent behind this is to let the home exerciser reap the benefits of a health club workout in the home. However, much of the home equipment cannot provide to the user the same benefits gained from the health club for one of two reasons: (1) the user lacks the knowledge of how to use the equipment properly, such as lining it up properly and attaching it properly; and (2) the user does not have any basis for determining if progress is being made, or if the device is still effective after a long period of use.

Thus, there is clearly a need for home exercise equipment in which the method of use and placement during exercise is self-evident to the user. There is also a need for home exercise equipment which indicates to the user changes in his/her progress or changes in the exercise equipment itself.

SUMMARY OF THE INVENTION

Accordingly, the present invention is directed to home exercise equipment that substantially obviates one or more of the problems due to limitations and disadvantages of the related art. The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, one aspect of the present invention includes exercise equipment including a stretchable member having at least two fixable portions and at least one intermediate portion between the two fixable portions, the intermediate portion capable of being stretched by a user during exercise between a relatively relaxed condition offering relatively little resistance between the two fixable portions and a relatively elongated condition offering relatively greater resistance between the two fixable portions; and at least one indicator positioned at a preselected location on the stretchable member visible to a user of the exercise equipment and identifying to the user one of a desirable location on the stretchable member or a relative degree of resistance provided by the stretchable member.

The invention further includes exercise equipment wherein the indicator may take the form of a contrasting colored area, lines, symbols, numerals or letters.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENT

Reference will now be made in detail to the present exemplary embodiments of the invention, examples of which are illustrated in the accompanying drawings. Wherever possible, the same reference numbers will be used throughout the drawings to refer to the same or like parts.

Generally, a number of different types of exercise equipment utilize a stretchable or flexible member which is visible to the user. This equipment is intended to be used alone or in conjunction with other equipment. The present invention relates to an improvement in flexible resistance exerciser equipment and their manner of use. A number of such types of exercise products are commercially available including the HardBody Fitness Bar, HeavyRope Crosstrainer, Life-Line Gym, Tunturi Latex Workout Bands, Tunturi Seat Shaper, Tony Little's Abs Only Machine, Tony Little's Ab Isolator, Buns of Steel, Fitness Pro Ultra Toner, Fitness Pro Step Tube, and Power Coil Golf Swing Guide. As embodied herein, the flexible resistance exerciser equipment may be modified by adding markings or indicators onto the stretchable component of the exercise equipment.

These markings or indicators serve to indicate a desirable location on the stretchable member to the user, to indicate a relative degree of resistance provided by the stretchable member, to indicate a degree of wear or fatigue to the stretchable member, or any combination of the above.

Figure 1:
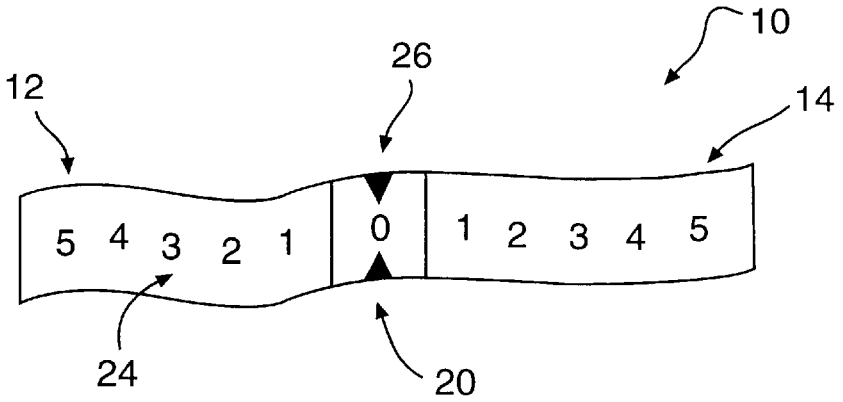
FIG. 1 is a plan view of an embodiment of a flexible exerciser having markings or indicators according to the present invention.
Figure 2:
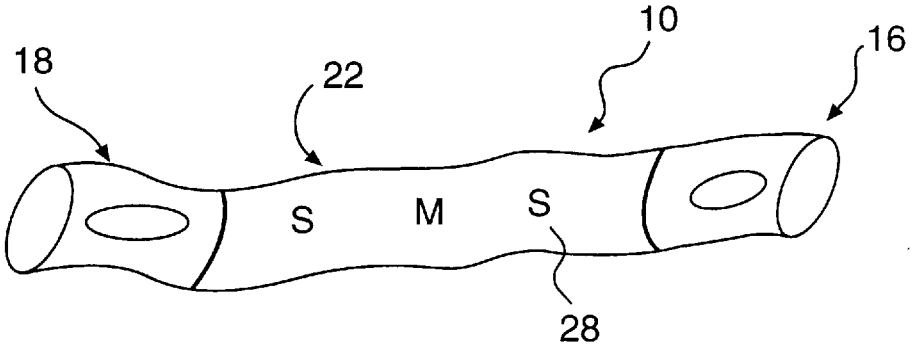
FIG. 2 is plan view of a second embodiment of a flexible exerciser having markings or indicators according to the present invention.

As embodied herein and shown in FIGS. 1 and 2, the flexible resistance exerciser equipment includes a stretchable member 10 having a fixable portions 12, 14, 16, 18 and stretching portions 20, 22. Fixable portions 12, 14 may be part of the stretchable member 10 or may include handles 16, 18 of various types. Stretchable member 10 may be made of any elastic material of suitable resistance and elasticity, such as latex or any other rubber or synthetic elastic material. Stretchable member 10 may be in the form of a tube, rope, strap, bar, loop, chain, coil or other configuration.

Figure 3:
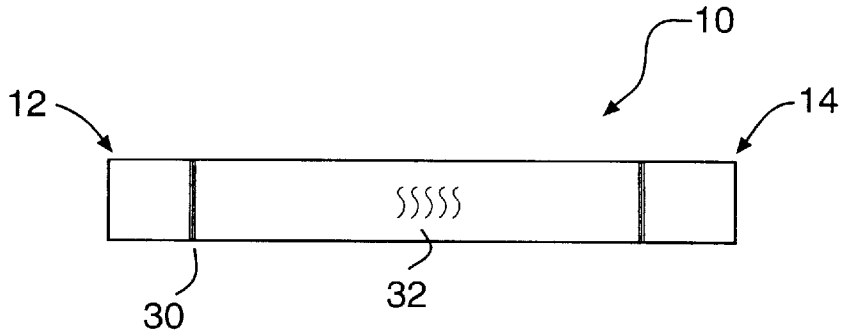
FIG. 3 is a plan view of a third embodiment of a flexible exerciser having markings or indicators according to the present invention.
Figure 4:
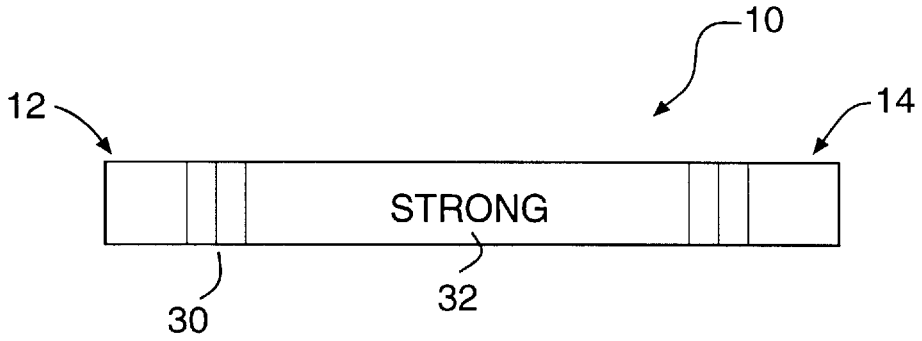
FIG. 4 is a plan view of the flexible exerciser of FIG. 3 after it has been stretched.
Figure 5:
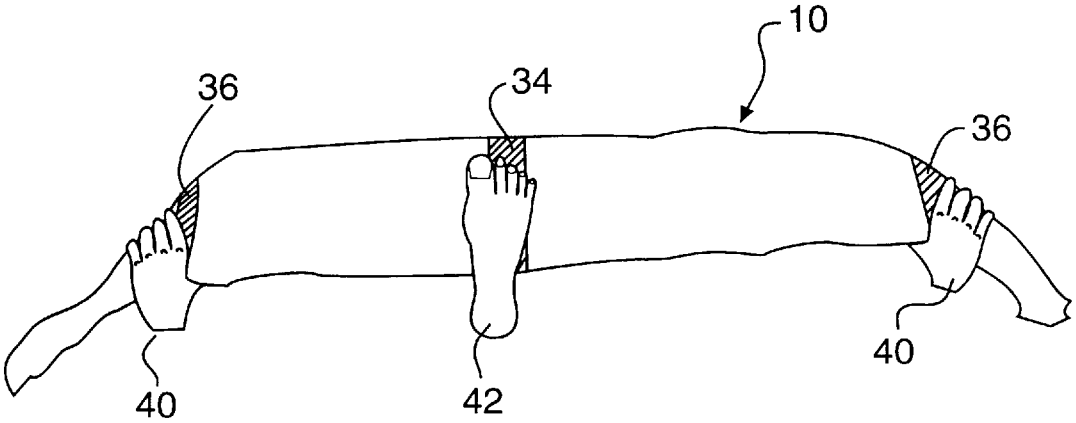
FIG. 5 is a plan view of a flexible exerciser with markings or indicators according the present invention in contact with a user's body parts.
Figure 6:
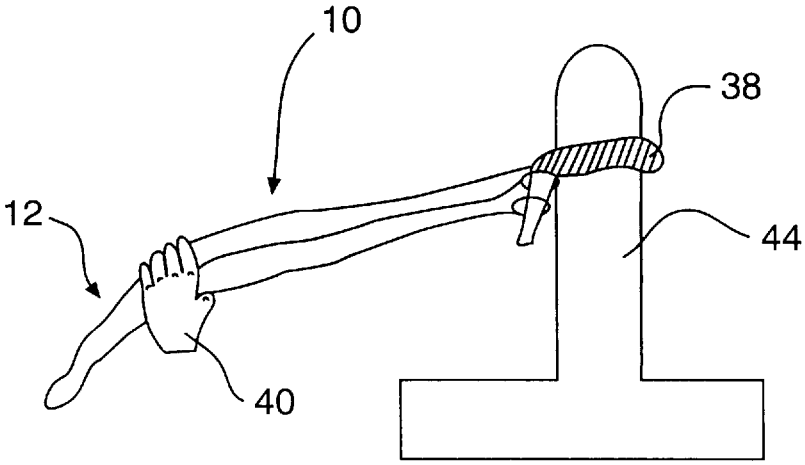
FIG. 6 is an elevation view of a flexible exerciser with markings or indicators according to the present invention in contact with another piece of equipment.

In use, the user of the flexible resistance exercise equipment must contact the equipment, either with a body part or another piece of equipment. In order to ensure that stretchable member 10 of the flexible exercise equipment is contacted in the proper location, it is desirable to add markings or indicators to indicate the proper location for contacting. As seen in FIGS. 1–6, the markings or indicators 24, 26, 28, 30, 32, 34, 36 and 38 may take various forms and be applied to stretchable member 10 in a variety of manners. The markings or indicators 24, 26, 28, 30, 32, 34, 36 and 38 may be applied to stretchable member 10 by painting, pasting, gluing, drawing, dyeing, clamping, snapping or stamping. Markings or indicators 24, 26, 28, 30, 32, 34, 36 and 38 may take the form of hash marks, numerals, colored areas contrasting with the color of the stretchable member, lines, symbols or letters. As seen in FIG. 5, markings or indicators 34, 36 may indicate the proper location for a user to step on the stretchable member or to grasp or wind the stretchable member around a hand 40, foot 42 or other body part. Additionally, markings or indicators may indicate the proper location for a user to twist, roll or wind up the stretchable member to increase resistance. As seen in FIG. 6, marking or indicator 38 on stretchable member 10 may indicate the proper location for a user to attach a bar 44, handle, stirrup or other device to the stretchable member. Marks or indicators 24, 26, 28, 30, 32, 34, 36 and 38 may be centered on stretchable member 10, evenly spaced along the length of stretchable member 10, generally spaced shoulder width apart, evenly spaced out from a center portion and numerically indicated, or placed on only a portion of stretchable member 10. A centered mark or indicator may be numbered zero, and indicators on either side of the centered mark or indicator may be consecutively numbered (see FIG. 1). Alternatively, letters may be used to for different indicators (see FIG. 2).

In use, the user of the flexible resistance exerciser equipment stretches stretchable member 10 between a relatively relaxed condition (FIG. 3) offering relatively little resistance between the fixable portions 12, 14 and a relatively elongated condition (FIG. 4) offering relatively greater resistance between the fixable portions 12, 14. In order to enable the user to differentiate between levels of resistance, and to observe their progress, it is desirable to add indicators or markings 24, 26, 28, 30, 32, 34, 36 and 38 to stretchable member 10 in order to indicate changes in resistance during use. As embodied herein and as shown in FIGS. 3 and 4, the markings or indicators 30, 32 may take the form of a dense colored area on a portion of stretchable member 10 which contrasts with the remainder of stretchable member 10. As the user applies force to stretch stretchable member 10, stretchable member 10 becomes stretched beyond its normal static size and the dense contrasting colored area on the stretchable member becomes less dense and changes in appearance. As shown in FIGS. 3 and 4, the change in appearance may result in the contrasting colored area separating into letters or lines as resistance increases. Alternatively, hash marks, symbols or numerals may be used, and increasing space between the marks would indicate an increase in resistance, thus providing feedback to the user. If the user can achieve the highest level of resistance indicated on the stretchable member easily, it is an indication that the user may benefit from using a stretchable member with a higher tensile strength which will provide greater resistance. When the force applied by the user is released, stretchable member 10 returns to its normal static size and the contrasting colored area returns to its original dense configuration. If the contrasting colored area does not return to its original configuration, this indicates to the user that either the stretchable member is in need of replacement and is fatigued or worn out, either from too much use or because of other material failure. In this embodiment, the dense contrasting colored area marking or indicator when stretched may create symbols, spell out words, or create other unique displays that appear only when the stretchable member is stretched to various degrees, thus providing feedback to the user.

In operation, the user may contact the stretchable member at a visible indicator indicating a desired location with a body part or another piece of equipment. The user then stretches the stretchable member by applying force to achieve the desired resistance. To determine if the desired resistance is achieved, the user may watch an indicator to observe what level of resistance has been reached during stretching by observing changes in the configuration and/or density of the indicator on the stretchable member. By examining the stretchable member after use, the user may determine by observing the indicator and determining whether it has returned to its original configuration, whether the stretchable member is in need of replacement.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Exercise equipment comprising:

a stretchable member having at least two fixable portions and at least one intermediate portion between the two fixable portions, the intermediate portion capable of being stretched by a user during exercise between a relatively relaxed condition offering relatively little resistance between the two fixable portions and a relatively elongated condition offering relatively greater resistance between the two fixable portions; and at least one indicator including a contrasting colored area of the stretchable member positioned at a preselected location on the stretchable member visible to a user of the exercise equipment and identifying to the user a desirable location on the stretchable member, a relative degree of resistance provided by the stretchable member, or both a desirable location and a relative degree of resistance.

2. Exercise equipment according to claim 1 wherein the fixable portions include handles.

3. Exercise equipment according to claim 1 wherein the indicator includes numerals.

4. Exercise equipment according to claim 1 wherein the indicator includes at least two indicators adapted for being spaced at a distance shoulder width apart from each other along the stretchable member.

5. Exercise equipment according to claim 1 wherein the indicator includes several indicators evenly spaced along a length of the stretchable member.

6. Exercise equipment according to claim 5 wherein the indicators include numerals.

7. Exercise equipment according to claim 1 wherein the indicator is located at a center position of the stretchable member.

8. Exercise equipment according to claim 7 wherein the indicator includes indicators adapted for being spaced shoulder width apart from each other along the stretchable member and centered on the stretchable member.

9. Exercise equipment according to claim 7 wherein the indicator at the center position is numerically identified as zero.

10. Exercise equipment according to claim 7 including a plurality of indicators on either side of the center of the stretchable member.

11. Exercise equipment according to claim 10 wherein the indicators on either side of the stretchable member are consecutively numbered.

12. Exercise equipment according to claim 1, wherein the contrasting colored area changes configuration or color as the stretchable member is stretched, thereby indicating an increase in resistance.

13. Exercise equipment according to claim 1, wherein as the stretchable member is stretched, the contrasting colored area separates into separate lines, symbols or letters on the stretchable member thereby indicating an increase in resistance.

14. Exercise equipment according to claim 13 wherein the separate lines, symbols or letters merge back into the contrasting colored area as resistance is decreased and the stretch is released; and wherein failure of the separate lines, symbols or letters to merge back into the contrasting colored area after the stretch is released indicates that the stretchable member is in need of replacement.

15. Method of using exercise equipment comprising:

providing a stretchable member having at least two fixable portions and at least one intermediate portion between the two fixable portions, the intermediate portion capable of being stretched by a user doing exercise between a relatively relaxed condition and offering relatively little resistance between the two fixable portions and a relatively elongated condition offering relatively greater resistance between the two fixable portions;

directly contacting the stretchable member where at least one indicator positioned at a preselected location on the stretchable member is visible to the user of the exercise equipment; and stretching the stretchable member between a relatively relaxed condition and a relatively elongated condition.

16. The method of claim 15 wherein the directly contacting step includes stepping on, grasping, or attaching the stretchable member.

17. The method of claim 15 wherein the directly contacting step includes contacting the stretchable member with a body part of the user.

18. The method of claim 15 wherein the directly contacting step includes fixing the stretchable member to another piece of equipment.

19. Method of using exercise equipment comprising:

providing a stretchable member having a least two fixable portions and at least one intermediate portion between the two fixable portions, the intermediate portion capable of being stretched by a user doing exercise between a relatively relaxed condition offering relatively little resistance between the two fixable portions and a relatively elongated condition offering relatively greater resistance between the two fixable portions;

stretching the stretchable member between a relatively relaxed condition and a relatively elongated condition; and determining the degree of resistance provided by the stretchable member by viewing an indicator including a contrasting colored area of the stretchable member positioned on the stretchable member.

* * * * *